US009586658B2

(12) United States Patent
Nutz et al.

(10) Patent No.: US 9,586,658 B2
(45) Date of Patent: Mar. 7, 2017

(54) ELEVATED KAYAK SEAT

(71) Applicant: Confluence Outdoor, LLC, Greenville, SC (US)

(72) Inventors: Hans Eric Nutz, Easley, SC (US); Lee Patrick Ward, Gaffney, SC (US)

(73) Assignee: Confluence Outdoor, LLC, Greenville, SC (US)

( * ) Notice: Subject to any disclaimer, the term of this patent is extended or adjusted under 35 U.S.C. 154(b) by 0 days.

(21) Appl. No.: 14/689,824

(22) Filed: Apr. 17, 2015

(65) Prior Publication Data

US 2016/0304171 A1 Oct. 20, 2016

(51) Int. Cl.
*B63B 35/71* (2006.01)
*B63B 29/04* (2006.01)

(52) U.S. Cl.
CPC ..... *B63B 29/04* (2013.01); *B63B 35/71* (2013.01); *B63B 2029/043* (2013.01); *B63B 2035/715* (2013.01)

(58) Field of Classification Search
CPC ..... B63B 35/71
USPC ..... 114/363, 347
See application file for complete search history.

(56) References Cited

U.S. PATENT DOCUMENTS 3,871,317 A * 3/1975 Szpytman ..... B63B 1/12 114/282
4,340,004 A * 7/1982 Kanei ..... B63B 1/10 114/289
4,768,454 A 9/1988 Selken
4,803,945 A * 2/1989 Adams ..... B63B 29/04 114/363
5,619,949 A * 4/1997 Dick, Jr. ..... B63B 29/04 114/363
5,622,403 A * 4/1997 Gonda ..... B63B 7/06 114/363

(Continued)

FOREIGN PATENT DOCUMENTS

DE 443760 5/1927
EP 2702901 3/2014

OTHER PUBLICATIONS

Old Town Predator Steady Stand Bar, http://www.austInkayak.com/products/13783/Old-Town-Predator-Steady-Bar.html (last visited Jul. 10, 2015), known at least as early as Apr. 16, 2015, 3 pgs.

(Continued)

*Primary Examiner* — Stephen Avila
*Assistant Examiner* — Javon Hayes
(74) *Attorney, Agent, or Firm* — Womble Carlyle Sandridge & Rice, LLP

(57) ABSTRACT

An elevated seat for a kayak. A floor of the kayak generally defines a reference plane. The seat may include a first support bar configured to be releasably attached to the kayak at a first location and a second support bar configured to be releasably attached to the kayak at a second location spaced along a bow-stern direction of the kayak relative to the first location. The seat may also include a seating member extending from a distal end of the first support bar to a distal end of the second support bar. The seating member may be inclined at a non-perpendicular angle relative to the floor. When in use, the first and second support bars are configured to position the seating member above the floor by a sufficient distance to support a user substantially standing on the floor.

20 Claims, 6 Drawing Sheets

(56) References Cited

U.S. PATENT DOCUMENTS

| | | | | |
|---|---|---|---|---|
| 5,651,706 | A | 7/1997 | Kasper | |
| 5,662,505 | A | 9/1997 | Spriggs | |
| 5,784,983 | A * | 7/1998 | Stegall | A47C 9/025 114/363 |
| 6,877,450 | B2 * | 4/2005 | Schmidt | B63B 1/04 114/61.13 |
| 7,168,666 | B2 * | 1/2007 | Tucker | B25H 1/04 182/181.1 |
| 7,194,972 | B2 * | 3/2007 | Schmitz, Sr. | B63B 1/10 114/61.1 |
| 7,634,971 | B2 * | 12/2009 | Lucas | B63B 1/08 114/61.15 |
| 7,789,035 | B1 * | 9/2010 | Rosenberg | B63B 29/04 114/347 |
| 8,166,899 | B1 * | 5/2012 | Min | B63B 1/38 114/67 A |
| 8,267,477 | B1 * | 9/2012 | Appiah Finn | A47C 16/025 108/115 |
| 8,869,731 | B2 * | 10/2014 | Dow | B63B 29/04 114/347 |
| 8,915,762 | B2 * | 12/2014 | Mostert | B63B 1/12 114/61.15 |
| 2007/0176429 | A1 * | 8/2007 | Lomerson | F03B 13/1815 290/53 |
| 2008/0083364 | A1 * | 4/2008 | Taylor | B63B 59/02 114/360 |
| 2010/0064959 | A1 * | 3/2010 | Huang | B63B 1/38 114/67 A |
| 2015/0011134 | A1 * | 1/2015 | Czarnowski | B63H 1/36 440/14 |
| 2016/0016640 | A1 * | 1/2016 | Sliwinski | B63C 11/44 114/68 |

OTHER PUBLICATIONS

Jackson Stand Up Bar, http://headwaterskayakshop.worldsecuresystems.com/Blog/old-town-predator-stand-up-bar (last visited Mar. 3, 2015), Mar. 3, 2015, 3 pgs.

H-Bar: Hobie Fishing, http://www.hobiefishing.com/accessories/h-bar/ (last visited Jul. 10, 2015), known at least as early as Apr. 16, 2015, 1 pg.

New Zealand Office Action for NZ App. #718558, dated Nov. 29, 2016, 6 pgs.

EP Search Report for EP App. No. 16165533, dated Oct. 10, 2016, 10 pgs.

* cited by examiner

ELEVATED KAYAK SEAT

FIELD OF DISCLOSURE

The present disclosure relates to small watercraft, such as kayaks. More particularly this disclosure relates to seating for small watercraft.

BACKGROUND

Outdoor enthusiasts embrace watersports. In the category of watercraft fishing, anglers are moving from large and noisy power boats to smaller personal watercraft such as kayaks. Fishermen are rediscovering the accessibility, portability, quiet travel, and lower cost of fishing from canoes and kayaks as was common hundreds of years ago. These small boats can travel into shallow water, marshes, and through narrow passages that larger boats cannot. Kayak fishing provides access to bodies of water that may be off limits to motor driven boats. Traveling in a kayak is also quieter above and below the water to avoid alerting the fish below. Anglers who use kayaks also spend less time and effort transporting, launching, pulling and maintaining their boats, to provide more time on the water catching fish.

To meet the demand from anglers, boat designers and manufacturers have developed open cockpit or sit-on-top kayaks designed for stability on the water, and designed with unique features to accommodate the rods, lures, tools, tanks, paddles, fish finders and other equipment carried by many kayak fishermen. In many cases, fisherman would prefer to stand while fishing. The standing position provides the fisherman with improved sight lines for seeing the fish in the water. The standing position allows for a greater range of motion, and improved control when casting, reeling, or netting the fish because the standing position allows for the use of the angler's legs. Many kayak fishermen also find it more comfortable to stand than remain seated in a customary kayak seated position. Others may become tired when standing for long periods of time, especially when their legs are working to maintain balance within the boat.

Therefore, even with improvements in stability designed into kayak configured for fishing, there remains a need for a device that may help kayak fishermen achieve a balance between the benefits of the sitting and standing positions during a long day on the water.

SUMMARY

Some embodiments of the present disclosure include an elevated seat for a kayak. A floor of the kayak generally defines a reference plane. The seat may include a first support bar configured to be releasably attached to the kayak at a first location and a second support bar configured to be releasably attached to the kayak at a second location spaced along a bow-stern direction of the kayak relative to the first location. The seat may also include a seating member extending from a distal end of the first support bar to a distal end of the second support bar. The seating member may be inclined at a non-perpendicular angle relative to the floor. When in use, the first and second support bars are configured to position the seating member above the floor by a sufficient distance to support a user substantially standing on the floor.

Other embodiments of the present disclosure include a seat for a kayak having a floor and a deck, the floor of the kayak generally defining a reference plane. The seat may comprise at least one support and a seating member positioned upon the support. The seat may have an in-use position and a stowed position. In the stowed position, the seating member lies generally parallel to at least one support. In the in-use position, the seating member is inclined at a non-perpendicular angle relative to the reference plane and the at least one support is arranged such that a user seated on the seating member with the feet of the user flat on the floor will have the knees of the user bent by less than 90 degrees.

Still other embodiments of the present disclosure include a kayak comprising a body having a deck, a floor, a bow and a stern. The kayak may also comprise a first seat removably coupled to the body for supporting a user in a seated position. The kayak may also comprise a second seat, wherein the second seat is foldable between an in-use position for supporting the user in a generally standing position, and a stowed position wherein the second seat generally lies along the deck.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
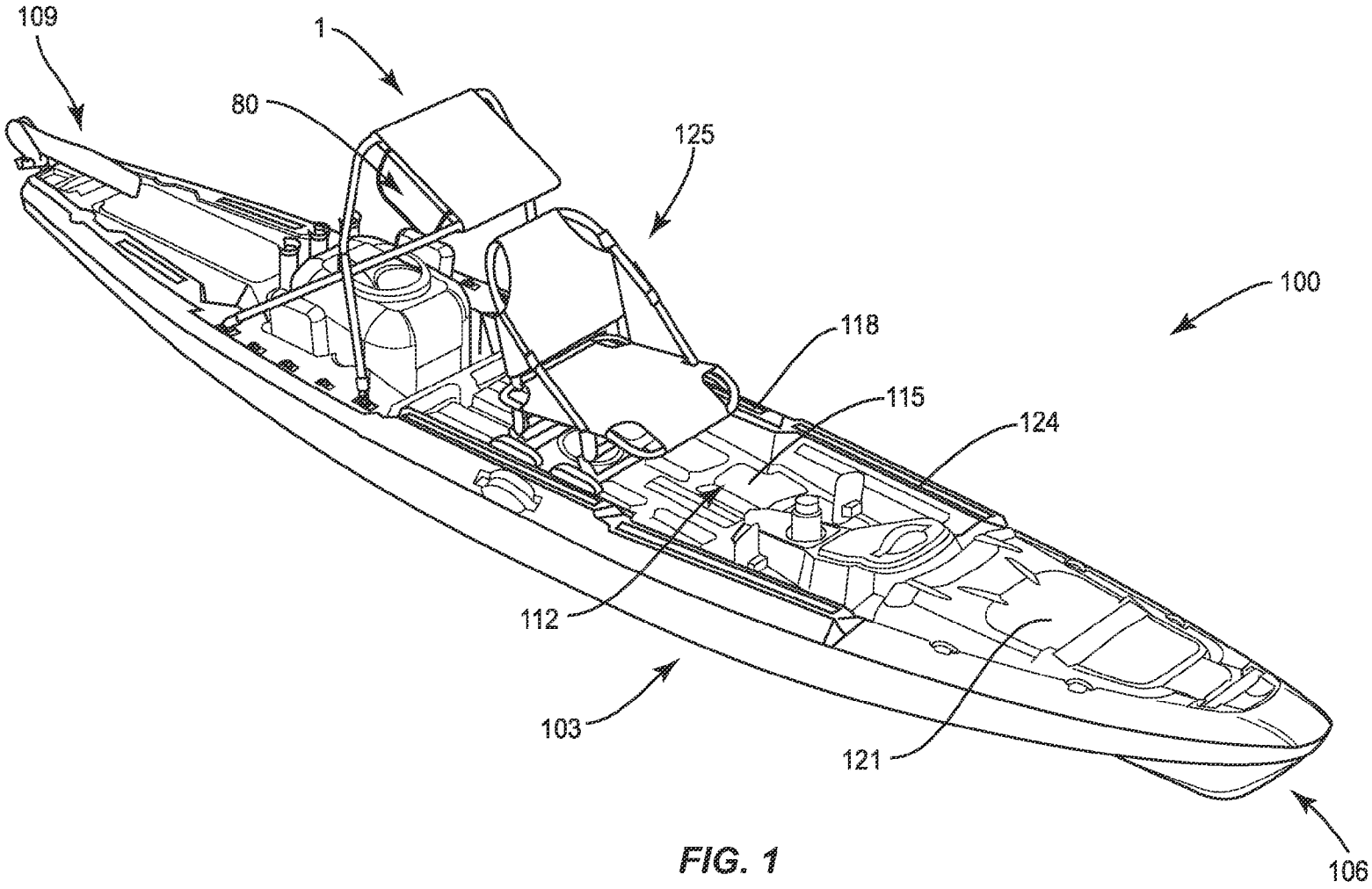
FIG. 1 shows a kayak having an elevated seat according to embodiments of the present disclosure.

Turning to the figures, FIG. 1 shows an elevated seat 1 in an in-use position mounted to a kayak 100. As used herein, the term "kayak" is used generally to describe watercraft or boats that are less than about 16 feet long, less about 4 feet wide and weigh less than about 150 pounds. The "kayak" may be considered a personal watercraft, but is not limited to a single occupant. As used herein, the term "kayak" includes boats generally referred to as canoes, and also includes stand-up paddle boards. The term "kayak" also includes watercraft that may be generally referred to as rowboats. As used herein, "kayaks" are not limited to paddle powered boats, but also include pedal powered boats, or boats with electric motors.

The kayak 100 includes a body 103 having a bow 106 and a stern 109. The body 103 may generally define a cockpit 112 that has a floor 115. The floor 115 may be contoured to facilitate draining of water into one or more scuppers, but may be described as generally planar to define a reference plane. The reference plane may be parallel with the anticipated waterline of the kayak 100, i.e. the line created by the water when an empty boat is floated on calm water. One possible benefit of a generally flat, planar floor 115 is the ability of the user to stand upon the floor 115. The gunwale of the kayak 100 may form a deck 118. A variety of storage compartments 121 and cavities may be formed into the deck 118 of the body 103. Various attachment hardware 124 may be mounted to the deck 118, or elsewhere on the body 103. The compartments 121 and hardware 124 provide for the mounting, storage, or staging of rods, paddles, live-wells, bait, lures, tools, fish finders, personal effects, and other items required for a successful day on the water.

Figure 4:
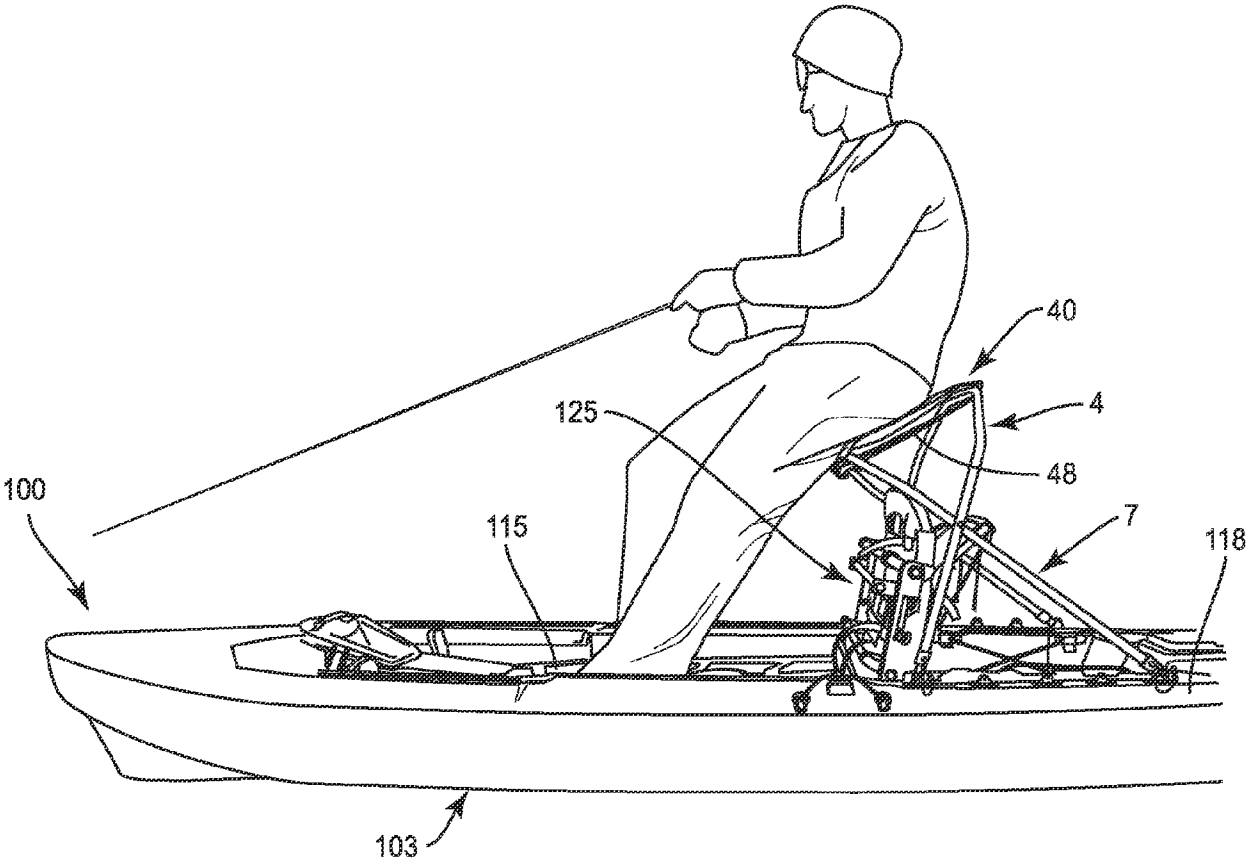
FIG. 4 is a side view of an elevated seat mounted above a primary seat in a kayak according to embodiments of the present disclosure.

A paddling seat 125 may be removably coupled to the kayak 100 in a position corresponding with the cockpit 112. The paddling seat 125 is configured to support the user in a seated position relatively low to the water. The paddling seat 125 may be used when paddling, pedaling, or trolling to or between fishing spots. A user in the paddling seat 125 can extend their legs toward the bow 106, along the cockpit 112. In some embodiments the paddling seat 125 includes a seat portion 127 and a back portion 129 (see FIG. 6). The paddling seat 125 may be mounted for sliding along the bow-stern direction. The seat portion 127 may fold relative to the back portion 129. When not in use, the paddling seat 125 may be staged in a substantially vertical orientation with the seat portion 127 and the back portion 129 folded together at a location below the elevated seat 1 (see FIG. 4).

Exemplary features of the elevated seat 1 will become more apparent with reference to FIGS. 2-6. The elevated seat 1 may include a first support bar 4 and a second support bar 7. In some embodiments, only a single support bar may be used. Each support bar 4, 7 may have a U-shape with a pair of legs 11 extending from a cross beam 14. Therefore, there may be four legs 11 total. In other embodiments, less than four total legs 11 may be present as fewer support bars are employed or the support bars are not U-shaped. In one example, a single leg 11 may be sufficient. In another example, a three leg arrangement may be provided.

Figure 3:
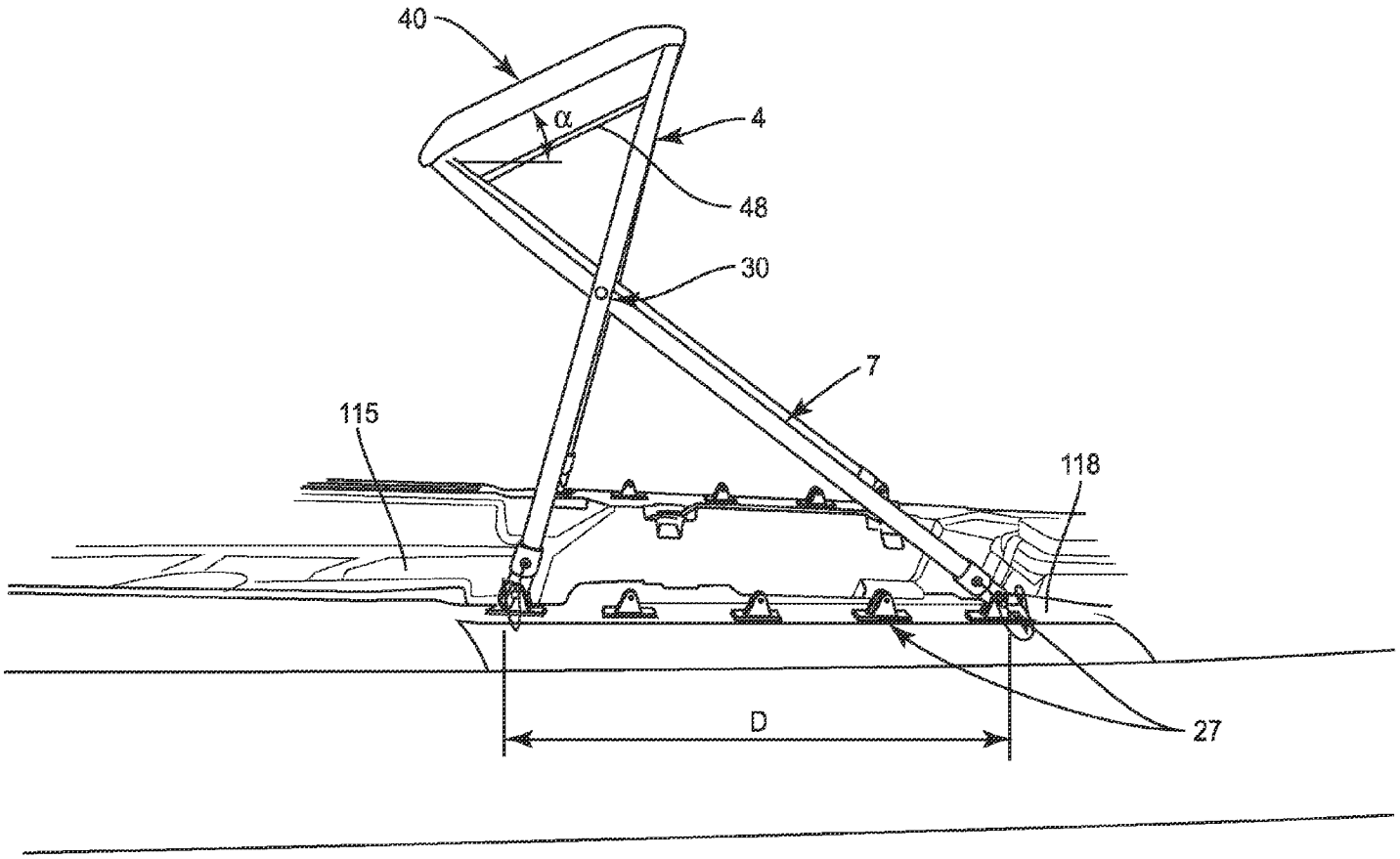
FIG. 3 is a side profile view of the elevated seat according to FIG. 2.

In the illustrated embodiment, each support bar 4, 7 may lie along a single plane, as best seen in FIG. 3. The cross beam 14 connects the legs 11 of each support bar 4, 7 at one distal end of the legs 11. The opposite end 20 may be configured to be releasably attached to the kayak 100. Each opposite end 20 may be attached and detached using a quick release pin 24 that provides a pivoting connection between the support bars 4, 7 and the body 103, or brackets 27 mounted to the kayak 100. In other embodiments, the opposite ends 20 may be mounted to the kayak 100 by other fasteners or joints known in the art. In one example, the opposite ends 20 may drop into fishing rod holders mounted to the kayak 100. In some embodiments, at least one of the support bars 4, 7 may be attached to the kayak 100 in a substantially permanent manner.

Figure 5:
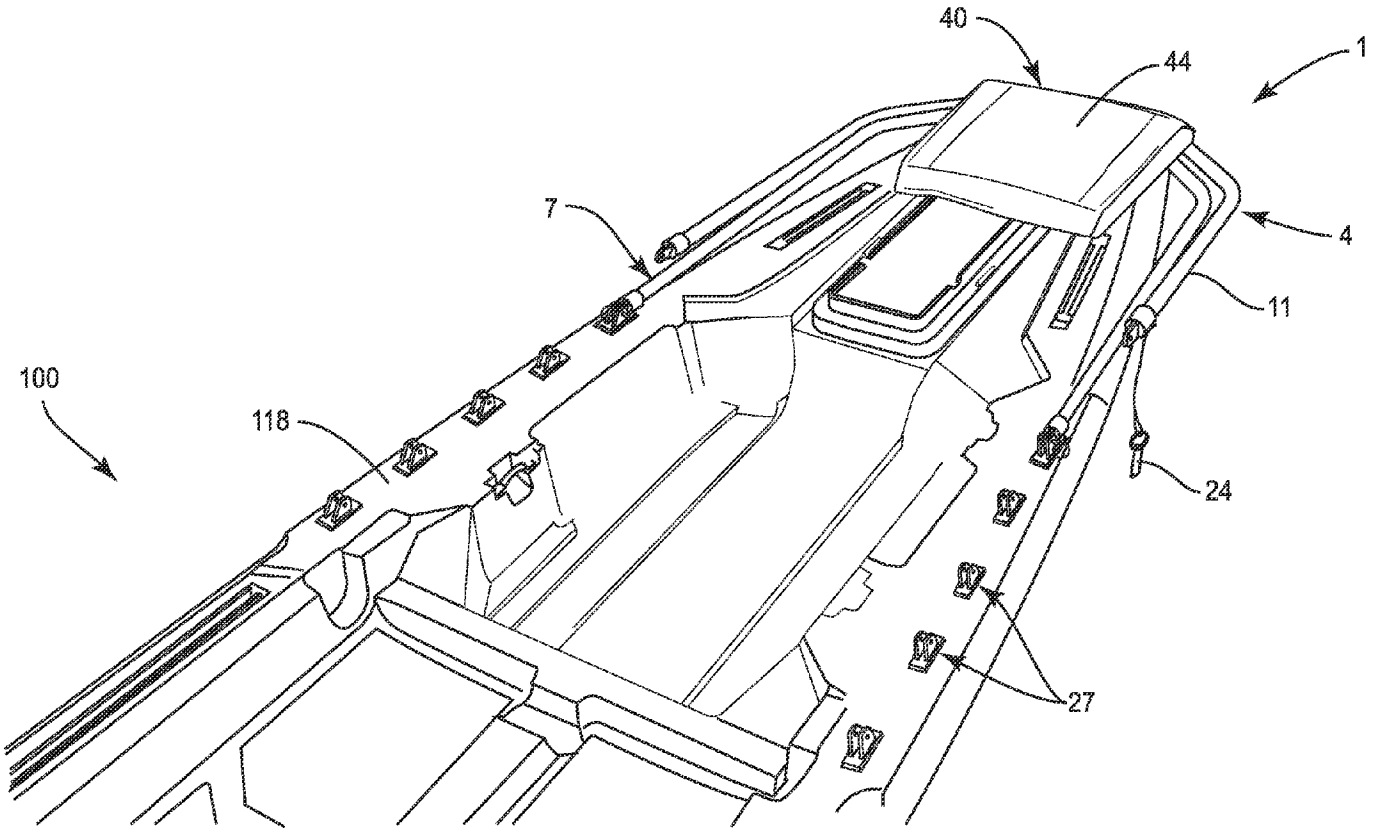
FIG. 5 is a perspective view of an elevated seat in a stowed position according to embodiments of the present disclosure.

In the illustrated embodiment, the first support bar 4 and the second support bar 7 may be joined together by at least one pivot joint 30. The pivot joint 30 is configured to allow the first support bar 4 to pivot relative to the second support bar 7. In one embodiment, the second support bar 7 is configured to nest within the first support bar 4 when the support bars 4, 7 are pivoted into a substantially coplanar orientation as seen in FIG. 5. In some embodiments, the first support bar 4 crosses the second support bar 7 when viewed from a profile direction, as seen in FIG. 3, when the elevated seat 1 is in an unfolded, deployed, or in-use position. In other embodiments, the support bars 4, 7 may not cross when the seat is in the in-use position.

In the illustrated embodiment, the pivot joint 30 is formed where the first support bar 4 crosses the second support bar 7. In the in-use position, the opposite end 20 of each leg 11 is mounted to the kayak 100. The distance D along the bow-stern direction between the legs 11 of the first support bar 4 and the legs 11 of the second support bar 7 is held fixed in the in-use position to help minimize the chance of collapse of the elevated seat 1.

When not in use, the elevated seat 1 may be staged in a folded or stowed position as best seen in FIG. 5. In the illustrated embodiment, the pins 24 connecting the legs 11 of the first support bar 4 to the kayak 100 are disengaged. The first support bar 4 is then able to pivot relative to the second support bar 7. The second support bar 7 is able to pivot relative to the deck 118 to stage the elevated seat 1 in a stowed position generally laid upon the deck 118, with the support bars 4, 7 nested with one another.

Figure 6:
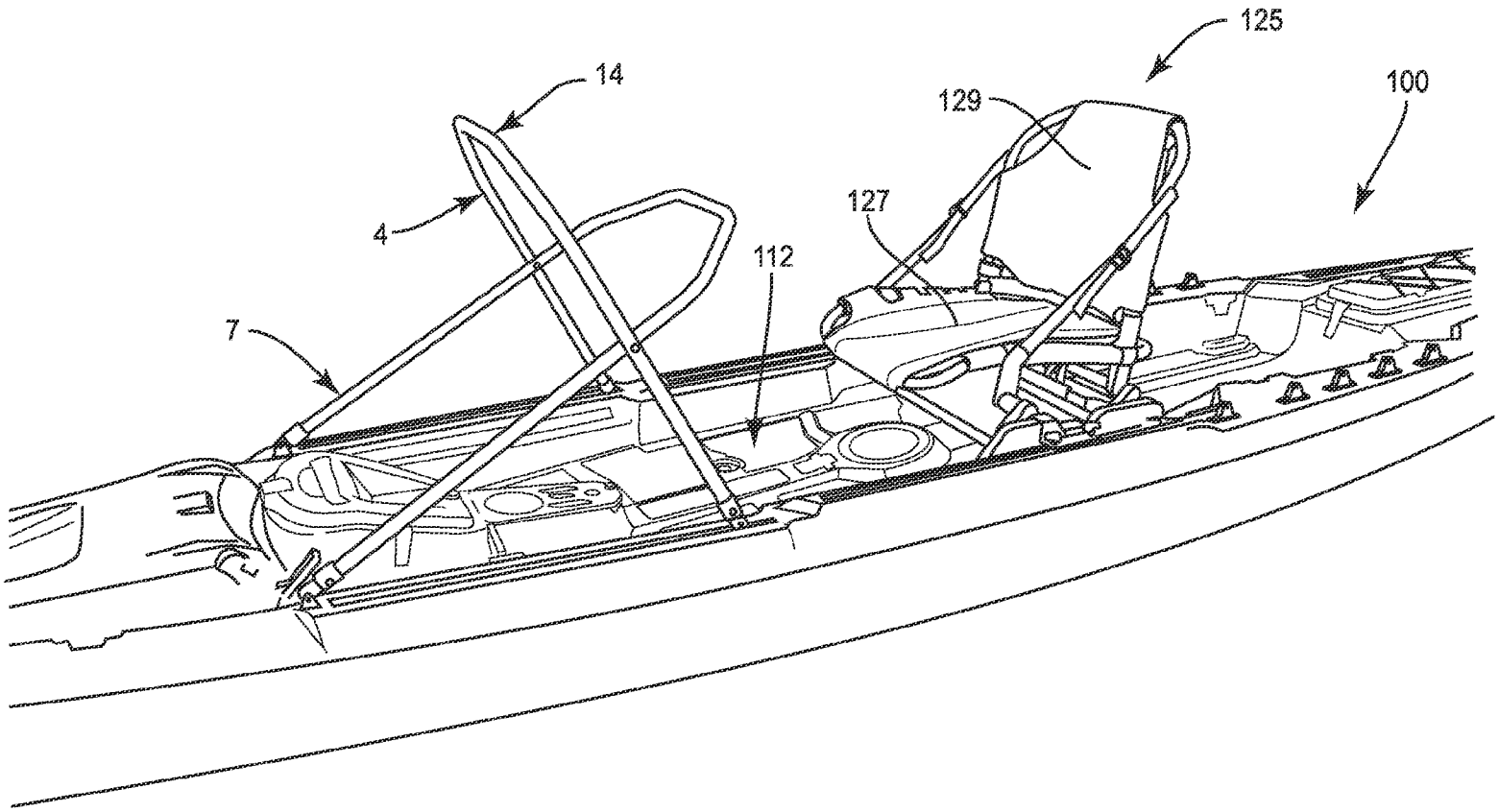
FIG. 6 is a perspective view of elements of an elevated seat mounted to a bow of a kayak according to embodiments of the present disclosure.

The elevated seat 1 further comprises a seating member 40 that defines a seating surface 44 upon which the user will sit. In some embodiments, the seating member 40 can include a fabric panel, such as a durable mesh, suspended between the cross beams 14 of the first support bar 4 and second support bar 7, respectively. The seat member 40 may include a padding layer. The mesh may be used to hold the cross beams 14 together in tension. The mesh material may be used for its comfort, breathability, and light weight. Alternatively, other fabrics, or even a rigid material may be used to form the seating member 40. The seating member 40 may be attached to the support bars 4, 7 with straps 48 or other known fasteners. In some embodiments the straps 48 may use hook and loop fasteners to removably attach the seating member 40 to the support bars 4, 7. In some embodiments, the straps 48 connect the seating member 40 to the support bars 4, 7 in such a manner that the seating member 40 is able to pivot, slide, or pivot and slide with respect to at least one of the support bars 4, 7. This functionality of the straps 48, or other fasteners, may at least partially facilitate the ability for the support bars 4, 7 to pivot with respect to one another to transition from the in-use position to the stowed position. The pivoting, sliding, or pivoting and sliding of the support bars 4, 7 relative to the seating member 40 may be particularly useful if the seating member 40 is constructed from a material of sufficient rigidity to maintain its shape. As seen in FIG. 6, the seating member 40 may assume an orientation generally parallel with the support bars 4, 7 in the stowed position. In other embodiments, the seating member 40 may be relatively flexible, capable of being folded as the support bars 4, 7 come together in the stowed-position.

The elevated seat 1 is configured so that the in-use position results in placement of the seating member 40 at a height above the floor 115 so that a user will be supported by the seating surface 44 while in a generally upright or leaning posture. A user seated on the seating member 40, with the feet of the user flat on the floor 115, will have the knees of the user bent by less than 90 degrees. By comparison a bend of 90 degrees would occur when a user's thighs are parallel with the floor 115 and the user's calves are perpendicular to the floor 115. A bend of more than 90 degrees could be generally described as a squatting position, or where a user's knees are above their hips when their feet on flat on the floor.

The seating member 40 is arranged upon the support bars 4, 7 to accept at least a portion of the user's weight along a vertical direction. Therefore, the seating surface 44 should not be perpendicular to the floor 115 in the in-use position. In some embodiments, the seating member 40 extending from the first support bar 4 to the second support bar 7 can be inclined to be both non-perpendicular and non-parallel relative to the floor 115. Having the seat member 40 parallel to the floor 115 may reduce the stability of the kayak 100 if insufficient weight of the user remains on their feet. The seating member 40 may form an angle of between ten and eighty degrees relative to the floor. For example, the seating member 40 may form a forty-five degree angle with the floor in the in-use position. In some embodiments, the in-use position provides the cross beam 14 of the first support bar 4 at a higher location relative to the floor 115 than the height of the cross beam 14 of the second support bar 7 to provide the incline. The inclined angle is represented by alpha in FIG. 3.

In some embodiments, the kayak 100 is provided with brackets 27 at predetermined locations along the bow-stern direction so that the first support bar 4 and the second support bar 7 can be attached to the kayak 100 at locations spaced apart along the bow-stern direction. The brackets 27 at predetermined locations provide a relatively fixed configuration for the elevated seat 1 in the in-use position.

In other embodiments, several extra brackets 27 may be disposed along the deck 118 for selectively attaching to the opposite ends 20 of the legs 11. By selectively attaching the legs 11 to the desired brackets 27, the bow-stern spacing distance D between the legs 11 can be adjusted, resulting in adjustment of the relative height and angle alpha of the seating member 40 in the in-use position. Alternatives may also be used in place of a plurality of brackets 27. For example, a rail may be provided where the opposite ends 20 of each leg 11 may be selectively held in place at selected locations along the rail.

The relative height of the seating member 40 may be adjusted in other ways. In some embodiments, the legs 11 may be configured to telescope. Adjusting the length of one or more of the legs 11 may result in increasing or decreasing the height of the seating member 40 relative to the floor 115 for comfortably positioning the seating member 40 based on the height of the user.

As seen in FIG. 6, the elevated seat 1 may be mounted relatively toward the bow 106 of the kayak 100 ahead of the primary seat 125. As shown in FIG. 6, the seating member 40 has been removed. In the illustrated embodiment, the elevated seat 1 may function as a stand-up bar to be grasped by a user standing within the kayak 100.

In still other embodiments, a storage basket 80 (see FIG. 1) may be held between the support bars 4, 7. The storage basket 80 may be made from a rigid material or the storage basket 80 may be a soft-sided container that can collapse when the elevated seat 1 is folded. The storage basket 80 may be covered by the seating member 40.

Figure 2:
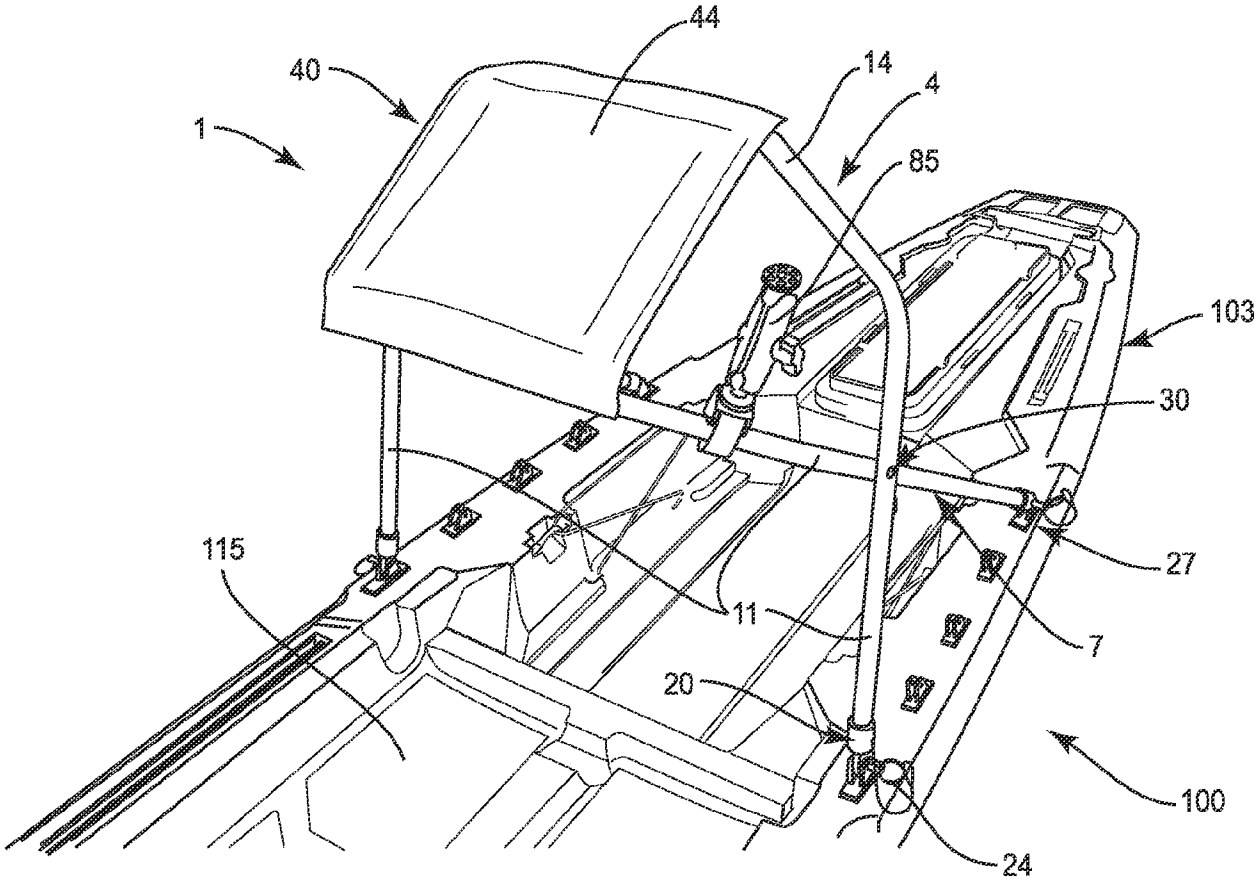
FIG. 2 is a perspective view of an elevated seat mounted to the stern of a kayak according to embodiments of the present disclosure.

In some embodiments, the support bars 4, 7 may be used to mount additional accessories, such as a camera mount 85 shown in FIG. 2. Fishing rod holders may also be mounted to the support bars 4, 7.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. An elevated seat for a kayak, a floor of the kayak generally defining a reference plane, the seat comprising:

a first support bar configured to be releasably attached to the kayak at a first location;

a second support bar configured to be releasably attached to the kayak at a second location spaced along a bow-stern direction of the kayak relative to the first location; and a seating member extending from a distal end of the first support bar to a distal end of the second support bar, wherein the seating member is inclined at a non-perpendicular angle relative to the floor, wherein, when in use, the first and second support bars are configured to position the seating member above the floor by a sufficient distance to support a user substantially standing on the floor, and the distal end of the first support bar is spaced from the distal end of the second support bar, and wherein, in a folded position, the seating member lies generally parallel to the first support bar and the second support bar.

2. The seat of claim 1, wherein the first and second support bars are generally U-shaped having a cross beam at the distal end of the support bars and a pair of legs, opposite ends of each leg are configured to be releasably attached to the kayak and the seating member is attached to the cross beam of each support bar.

3. The seat of claim 2, wherein the first support bar is pivotably attached to the second support bar such that the first support bar crosses the second support bar when the seat is in an in-use position.

4. The seat of claim 3, wherein the seating member is slidably attached to at least one of the first support bar and the second support bar to allow the seat to fold into the folded position.

5. The seat of claim 1, wherein the first support bar is positioned at a first height above the floor and the second support bar is positioned at a second height above the floor, and the first height is higher than the second height in an in-use position of the seat.

6. The seat of claim 1, wherein the seating member comprises a fabric panel.

7. A kayak, comprising:

a body having a deck, a floor, a bow and a stern;

a first seat for supporting a user in a seated position; and a second seat, wherein the second seat is foldable between an in-use position for supporting the user in a generally standing position, and a stowed position wherein the second seat generally lies along the deck, wherein the first seat is configured to reside under the second seat when the second seat is in the in-use position.

8. The kayak of claim 7, wherein the second seat is mounted relatively toward the stern.

9. The kayak of claim 7, wherein the second seat is mounted relatively toward the bow.

10. The kayak of claim 7, wherein the second seat comprises:

a first support bar configured to be releasably attachable to the kayak;

a second support bar configured to be releasably attachable to the kayak; and a seating member extending from a distal end of the first support bar to a distal end of the second support bar.

11. The kayak of claim 10, wherein the seating member is inclined at a non-perpendicular angle relative to the floor when the second seat is in the in-use position.

12. A kayak, comprising:

a body having a deck, a floor, a bow and a stern;

a first seat for supporting a user in a seated position; and a second seat, wherein the second seat is foldable between an in-use position for supporting the user in a generally standing position, and a stowed position wherein the second seat generally lies along the deck, wherein the second seat comprises:

a first support bar configured to be releasably attachable to the kayak, a second support bar configured to be releasably attachable to the kayak; and a seating member extending from a distal end of the first support bar to a distal end of the second support bar, and wherein, in the stowed position, the first support bar is attached to the kayak and the second support bar is unattached to the kayak, and in the in-use position, both the first support bar and the second support bar are attached to the kayak.

13. The kayak of claim 10, wherein the first support bar is pivotably attached to the second support bar such that the first support bar crosses the second support bar when the second seat is in the in-use position, and the first support bar and the second support bar are positioned generally parallel to one another when the second seat is in the stowed position.

14. The kayak of claim 10, wherein the seating member is slidably attached to at least one of the first support bar and the second support bar to allow the second seat to fold into the stowed position.

15. The kayak of claim 10, wherein the second seat comprises a fabric panel providing a seating surface.

16. The seat of claim 2, wherein each of the legs is bent such that the cross beam is shorter than the distance between the opposite ends of each leg.

17. The kayak of claim 12, wherein the seating member is inclined at a non-perpendicular angle relative to the floor when the second seat is in the in-use position.

18. The kayak of claim 12, wherein the first support bar is pivotably attached to the second support bar such that the first support bar crosses the second support bar when the second seat is in the in-use position, and the first support bar and the second support bar are positioned generally parallel to one another when the second seat is in the stowed position.

19. The kayak of claim 12, wherein the seating member is slidably attached to at least one of the first support bar and the second support bar to allow the second seat to fold into the stowed position.

20. The kayak of claim 12, wherein the second seat comprises a fabric panel providing a seating surface.

* * * * *